US009721778B2

(12) United States Patent
Harada

(10) Patent No.: US 9,721,778 B2
(45) Date of Patent: Aug. 1, 2017

(54) MASS SPECTROMETER

(71) Applicant: SHIMADZU CORPORATION, Kyoto, Kyoto (JP)

(72) Inventor: Takahiro Harada, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 14/768,683

(22) PCT Filed: Apr. 9, 2014

(86) PCT No.: PCT/JP2014/060311

§ 371 (c)(1),
(2) Date: Aug. 18, 2015

(87) PCT Pub. No.: WO2014/171378

PCT Pub. Date: Oct. 23, 2014

(65) Prior Publication Data

US 2015/0380229 A1 Dec. 31, 2015

(30) Foreign Application Priority Data

Apr. 19, 2013 (JP) ..... 2013-088907

(51) Int. Cl.
*H01J 49/16* (2006.01)
*H01J 49/40* (2006.01)
*H01J 49/04* (2006.01)

(52) U.S. Cl.
CPC ..... *H01J 49/164* (2013.01); *H01J 49/04* (2013.01); *H01J 49/40* (2013.01)

(58) Field of Classification Search
CPC ..... H01J 49/164; H01J 49/40; H01J 49/10; H01J 49/161; H01J 49/26; H01J 49/28
(Continued)

(56) References Cited

U.S. PATENT DOCUMENTS

2007/0045532 A1 3/2007 Brennen et al.
2008/0054172 A1* 3/2008 Seto ..... H01J 49/0036 250/282
(Continued)

FOREIGN PATENT DOCUMENTS

JP 6-76789 A 3/1994
JP 10-247471 A 9/1998
(Continued)

OTHER PUBLICATIONS

Martin Koestler et al., "A high-resolution scanning microprobe matrix-assisted laser desorption/ionization ion source for imaging analysis on an ion trap/Fourier transform ion cyclotron resonance mass spectrometer", Rapid Communications in Mass Spectrometry 2008, pp. 3275-3285, vol. 22.
(Continued)

*Primary Examiner* — Nicole Ippolito
(74) *Attorney, Agent, or Firm* — Sughrue Mion, PLLC

(57) ABSTRACT

A mass spectrometer (1) is provided with: an ionization chamber (10) for ionizing a sample (S) on its surface at an analysis point through irradiation by a laser beam; an analysis chamber (23) having a mass spectroscope (24) for detecting ions; a middle vacuum chamber (21, 22) arranged between the ionization chamber (10) and the analysis chamber (23); and an introduction pipe (12) or an introduction hole for allowing the inside of the housing (11) of the ionization chamber (10) to communicate with the inside of the middle vacuum chamber (21), wherein ions and fine particles, which have not been drawn into the introduction pipe (12) or introduction hole, can be prevented from spreading inside of the chamber. The structure of the mass spectrometer (1) further includes: an exhaust pipe (13); and a fan (15) for drawing air into the exhaust pipe (13) so that air that contains ions and/or fine particles, which have not been introduced into the introduction pipe (12) or introduction hole, can be suctioned up into the exhaust pipe (13) when the fan (15) is in operation.

7 Claims, 5 Drawing Sheets

(58) Field of Classification Search
USPC ..... 250/281, 282, 283, 288
See application file for complete search history.

(56) References Cited

U.S. PATENT DOCUMENTS

| | | | | |
|---|---|---|---|---|
| 2009/0045330 | A1 | 2/2009 | Wang et al. | |
| 2010/0006753 | A1* | 1/2010 | Schroeder | H01J 49/04 250/288 |
| 2010/0019140 | A1* | 1/2010 | Amirav | H01J 49/049 250/282 |
| 2013/0211211 | A1 | 8/2013 | Sato | |

FOREIGN PATENT DOCUMENTS

| | | | |
|---|---|---|---|
| JP | 2007-66903 | A | 3/2007 |
| JP | 2009-54441 | A | 3/2009 |
| JP | 2010-537371 | A | 12/2010 |
| WO | 2012/056730 | A1 | 5/2012 |

OTHER PUBLICATIONS

Takahiro Harada et al., "Visualization of Volatile Substances in Different Organelles with an Atmospheric-Pressure Mass Microscope", Anal. Chem. 2009, pp. 9153-9157, vol. 81.
International Search Report for PCT/JP2014/060311 dated Jun. 3, 2014.

* cited by examiner

MASS SPECTROMETER

CROSS REFERENCE TO RELATED APPLICATIONS

This application is a National Stage of International Application No. PCT/2014/060311 filed Apr. 9, 2014, claiming priority based on Japanese Patent Application No. 2013-088907 filed Apr. 19, 2013, the contents of all of which are incorporated herein by reference in their entirety.

TECHNICAL FIELD

The present invention relates to a mass spectrometer for ionizing a sample under atmospheric pressure or in an atmosphere where the gas pressure is close to atmospheric pressure in accordance with a matrix-assisted laser desorption/ionization (MALDI) method or another type of laser desorption/ionization method so that the generated ions are transported into a high vacuum atmosphere for mass spectroscopy.

BACKGROUND ART

In the fields of medicine (search for a novel biomarker, elucidation of disease mechanisms), pharmacology (application to pharmacokinetics/safety testing), engineering (application to materials development/deterioration analysis (organic EL, liquid crystal, solar batteries)), agriculture (detection of foreign substances (food safety testing), species improvement) and the like, samples are ionized and the generated ions are subjected to mass spectroscopy. In the case wherein a sample, such as of a drug or a peptide, is analyzed, a MALDI mass spectrometer having an atmospheric pressure MALDI ion source, a quadrupole ion trap, a time-of-flight mass spectrometer (TOFMS) and/or the like is used (see Patent Document 1). In such an atmospheric pressure MALDI mass spectrometer, ions generated in an atmospheric pressure MALDI ion source are captured by a quadrupole ion trap so as to be dissociated in multiple stages if necessary and are subjected to mass spectroscopy by a TOFMS.

FIG. 6 is a diagram showing the entire configuration of an atmospheric pressure MALDI mass spectrometer. Here, the X direction is one direction parallel to the ground, the Y direction is the direction perpendicular to the X direction and parallel to the ground, and the Z direction is the direction perpendicular to the X direction and the Y direction.

An atmospheric pressure MALDI mass spectrometer 201 is formed of an ionization chamber 210 for ionizing a sample S under atmospheric pressure ($10^5$ Pa, for example), and a mass spectroscopy unit 20 for detecting ions that have been introduced from the ionization chamber 210 in a high vacuum atmosphere ($10^{-3}$ Pa to $10^{-4}$ Pa, for example).

The mass spectroscopy unit 20 is equipped with a first middle vacuum chamber 21 that is adjacent to the ionization chamber 210, a second middle vacuum chamber 22 that is adjacent to the first middle vacuum chamber 21 and an analysis chamber 23 that is adjacent to the second middle vacuum chamber 22. In addition, the inside of the housing of the ionization chamber 210 is at atmospheric pressure ($10^5$ Pa, for example), the inside of the first middle vacuum chamber 21 is vacuumed to a low vacuum state ($10^2$ Pa, for example) by means of a rotary pump 26, the inside of the second middle vacuum chamber 22 is vacuumed to a middle vacuum state ($10^{-1}$ Pa to $10^{-2}$ Pa, for example) by means of a turbo molecular pump 25, and the inside of the analysis chamber 23 is vacuumed to a high vacuum state ($10^{-3}$ Pa to $10^{-4}$ Pa, for example) by means of a turbo molecular pump 25. That is to say, the atmospheric pressure MALDI mass spectrometer 201 forms a multi-stage differential vacuum system wherein the degree of vacuum can be increased step by step from the ionization chamber 210 towards the analysis chamber 23.

The ionization chamber 210 is provided with a chamber 11 (housing) in a rectangular parallelepiped form (width of 60 cm×depth of 60 cm×height of 80 cm, for example), a sample stage 50, an optical microscope 30 and a laser light source 41. As a result, a space is created inside of the chamber 11.

The lower surface inside of the chamber 11 is equipped with the sample stage 50. The sample stage 50 is provided with a sample table in a block form on which a sample S is mounted and a drive mechanism for driving the sample table in the X direction, the Y direction, and the Z direction.

The optical microscope 30 is placed inside the chamber 11 to the left. The optical microscope 30 is provided with a light source unit 31 for reflecting illumination and an image acquisition device 33 installed inside of the chamber 11 at the top, and a light source unit 32 for transmitted illumination placed inside of the chamber 11 at the bottom.

In such an optical microscope 30, a region set on a sample S placed at a predetermined observation point $P_1$ by means of a sample stage 50 is illuminated with a light emitted from a light source unit 31 for reflecting illumination in the −Z direction. Thus, the light reflected from the region set on the sample S in the Z direction is led to the image acquisition device 33. In addition, the region set on the sample S placed at the predetermined observation point $P_1$ by means of the sample stage 50 is illuminated with a light emitted from alight source unit 32 for transmitted illumination in the Z direction. Thus, the light that has transmitted through the region set on the sample S in the Z direction is led to the image acquisition device 33. As a result, the image acquisition device 33 displays an enlarged image of the region set on the sample S on a monitor, or the like, on the basis of the detected light. Thus, an operator can determine the analysis point (specified point) on the sample S while observing the enlarged image of the region set on the sample S. In addition, the computer allows the sample stage 50 to shift the sample S from the observation point $P_1$ to the ionization point $P_2$ on the basis of the information with which the analysis point (specified point) has been determined. Here, the usage of the light source unit 31 for reflecting illumination and/or of the light source unit 32 for transmitted illumination is selected depending on the transmittances of the substrate and the sample S.

In addition, a laser light source 41 for emitting a laser beam L in pulse form is installed in the upper right portion of the chamber 11 so that a matrix-assisted laser desorption/ionization method can be implemented.

Furthermore, a heater block with a built-in temperature adjusting mechanism is fixed to the right sidewall of the chamber 11. An introduction pipe 12 in a circular pipe form is created in the heater block and the inside of the chamber 11 communicates with the inside of the first middle vacuum chamber 21 via the introduction pipe 12. Here, the introduction pipe 12 is in an L shape and is arranged in such a manner that the inlet faces downwards (−Z direction) and the outlet faces to the right (X direction) inside of the first middle vacuum chamber 21.

In this ionization chamber 210, the analysis point on the sample S, which is placed at the predetermined ionization point $P_2$ by means of the sample stage 50, is irradiated from above by the laser beam L emitted from the laser light source 41. When the analysis point on the sample S is irradiated with the laser beam L, the target substance at the analysis point on the sample S is rapidly heated, vaporized and ionized. At this time, the air present inside of the chamber 11 flows into the first middle vacuum chamber 21 through the introduction pipe 12 due to the difference in pressure between the inside of the chamber 11 and the inside of the first middle vacuum chamber 21. The ions generated inside of the chamber 11 are also drawn into the introduction pipe 12 by riding on this airflow and are discharged into the first middle vacuum chamber 21.

A first ion lens is provided inside of the first middle vacuum chamber 21. The electrical field generated by the first ion lens helps the ions to be drawn into the introduction pipe 12 and, at the same time, converges the ions.

A three-dimensional quadrupole-type ion trap made up of one annular ring electrode and a pair of end cap electrodes arranged so as to face each other and sandwiching the ring electrode is provided inside of the second middle vacuum chamber 22. Thus, the ions that have been introduced into the second middle vacuum chamber 22 are sent into the analysis chamber 23 by the three-dimensional quadrupole-type ion trap.

A flight pipe and an ion detector 24 are provided inside of the analysis chamber 23. Thus, ions having a predetermined mass (strictly speaking, mass-to-charge ratio m/z) pass through the space in the flight pipe during a predetermined period of time. The ions that have passed through the flight pipe reach the ion detector 24, and the ion detector 24 outputs an ion intensity signal, depending on the amount of ions that has been reached, as a detection signal.

PRIOR ART DOCUMENT

Patent Document

Patent Document 1: Japanese Unexamined Patent Publication 2009-054441

SUMMARY OF THE INVENTION

Problem to be Solved by the Invention

In the above-described atmospheric pressure MALDI mass spectrometer 201, the ions generated inside of the chamber 11 are drawn into the introduction pipe 12 by riding on the airflow. However, such a problem arises wherein some ions and fine particles generated at the time of ionization are not drawn into the introduction pipe 12 but, instead, are spread within the chamber 11, which contaminates the entirety of the inside of the chamber 11. In particular, in the case wherein a biological sample, such as a tissue slice collected from a human body or an animal, is used as the sample S, the spreading of ions or fine particles (aerosol) causes a problem from the point of view of biological safety.

Therefore, an object of the present invention is to provide a mass spectrometer wherein ions and fine particles that have not been drawn into the introduction pipe can be prevented from spreading inside of the chamber.

Means for Solving Problem

In order to achieve the above-described object, a mass spectrometer is provided with: an ionization chamber for ionizing a sample on its surface at an analysis point through irradiation by a laser beam; and an analysis chamber having a mass spectroscope for detecting ions, wherein an introduction pipe or an introduction hole for introducing ions into the inside of the above-described analysis chamber from the inside of a housing of the above-described ionization chamber is created in the mass spectrometer, which further has: an exhaust pipe formed inside the housing of the above-described ionization chamber; and a fan for drawing air into the above-described exhaust pipe, in such a manner that air that contains ions and/or fine particles generated from the above-described sample, which have not been introduced into the above-described introduction pipe or introduction hole, can be suctioned up into the above-described exhaust pipe when the above-described fan is in operation.

Here, "fine particles" include molecules of a target substance that is released from the sample through irradiation by a laser beam, molecules of a substance other than the target substance, and a mixture of molecules of a target substance and of a substance other than the target substance.

In addition, "an introduction pipe or an introduction hole" is provided in order to lead ions from the inside of the housing of the ionization chamber to the inside of the analysis chamber. In the case wherein a middle vacuum chamber for increasing the degree of vacuum step by step is provided between the ionization chamber and the analysis chamber, the introduction pipe or introduction hole is provided to allow the inside of the housing of the ionization chamber to communicate with the inside of the middle vacuum chamber.

Effects of the Invention

As described above, in the mass spectrometer according to the present invention, ions and fine particles (aerosol) that have not been drawn into the introduction pipe or the introduction hole are suctioned up into an exhaust pipe and, thus, spread inside of the housing of the ionization chamber can be prevented and, thus, the contaminated region can be limited. At this time, the airflow volume of the fan can be optimized so that fine particles of which the size is relatively large are strongly affected by the gas flow, making it difficult for the fine particles to be drawn into the introduction pipe or the introduction hole. Meanwhile, ions of which the size is relatively small are less affected by the gas flow, making it easy for the ions to be drawn into the introduction pipe or the introduction hole. As a result, the MS sensitivity can be prevented from being affected.

Other Means for Solving Problem and Effects Thereof

In the mass spectrometer according to the present invention, the above-described exhaust pipe may communicate with the outside of the housing of the above-described ionization chamber, an airflow-in route may be formed on a wall of the above-described ionization chamber, and air that contains ions and/or fine particles, which have not been introduced into the above-described introduction pipe or introduction hole, may be discharged to the outside of the housing of the above-described ionization chamber.

In addition, the mass spectrometer according to the present invention, a filter for removing dust may be provided within the above-described airflow-in route.

In accordance with the mass spectrometer according to the present invention, dust can be prevented from entering into the housing of the ionization chamber.

Furthermore, the mass spectrometer according to the present invention, the above-described exhaust pipe may be connected with a collection unit, and air that contains ions and/or fine particles, which have not been introduced into the above-described introduction pipe or introduction hole, may be collected in the above-described collection unit.

Moreover, in the mass spectrometer according to the present invention, air that contains ions and/or fine particles, which have not been introduced into the above-described introduction pipe or introduction hole, may be returned to the inside of the housing of the above-described ionization chamber after ions and/or fine particles have been collected in the above-described collection unit.

In addition, the mass spectrometer according to the present invention, a filter having an antimicrobial action may be provided in the above-described collection unit.

Furthermore, in the mass spectrometer according to the present invention, the ionization method implemented in the above-described ionization chamber may be a matrix-assisted laser desorption/ionization method or a laser desorption/ionization method.

Moreover, in the mass spectrometer according to the present invention, the size of the inlet of the above-described exhaust pipe may be greater than the size of the inlet of the above-described introduction pipe or introduction hole, and the above-described introduction pipe or introduction hole may be provided inside the inlet of the above-described exhaust pipe.

DETAILED DESCRIPTION OF EMBODIMENTS

In the following the preferred embodiments of the present invention are described in reference to the drawings. Here, the present invention is not limited to the below described embodiments and various modifications are included as far as the gist of the present invention is not deviated from.

First Embodiment

Figure 1:
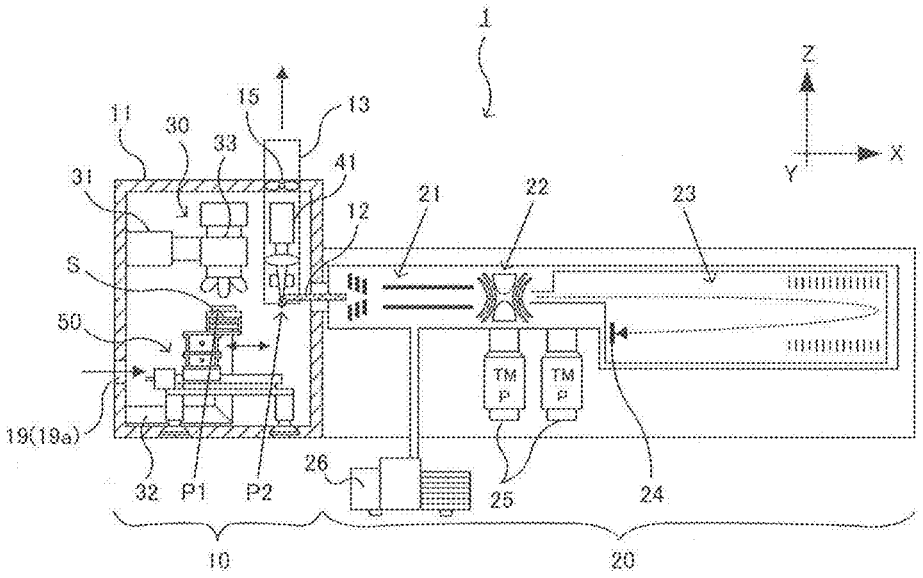
FIG. 1 is a diagram showing the entire configuration of the atmospheric pressure MALDI mass spectrometer according to one embodiment of the present invention.

FIG. 1 is a diagram showing the entire configuration of the atmospheric pressure MALDI mass spectrometer according to the first embodiment of the present invention. Here, a sample S is a tissue slice (biological sample) collected from a human body, for example, and is mounted on a conductive sample plate (76 mm×26 mm×1 mm, for example). In addition, the same symbols are attached to the same components as in the above-described atmospheric pressure MALDI mass spectrometer 201.

The atmospheric pressure MALDI mass spectrometer 1 is formed of an ionization chamber 10 for ionizing the sample S under atmospheric pressure ($10^5$ Pa, for example) and a mass spectroscopy unit 20 for detecting ions introduced from the ionization chamber 10 in a high vacuum atmosphere ($10^{-3}$ Pa to $10^{-4}$ Pa, for example).

Figure 2:
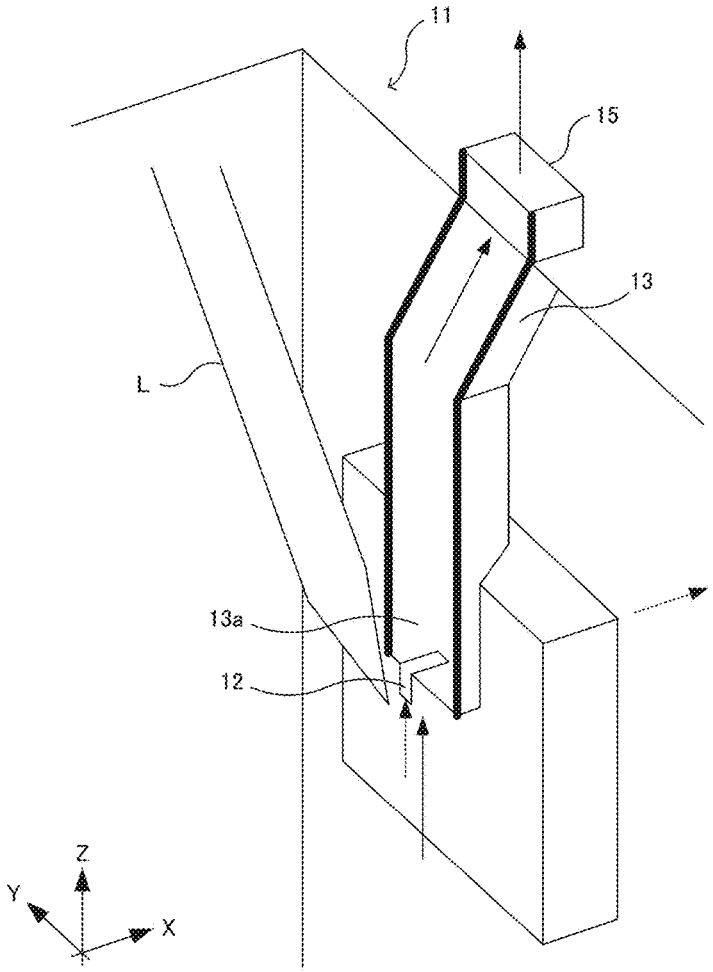
FIG. 2 is a perspective diagram showing the configuration of the main portion of the ionization chamber in the first embodiment.

Here, FIG. 2 is a perspective diagram showing the configuration of the main portion of the ionization chamber 10 according to the first embodiment. In the figure, the exhaust duct 13 is shown cut open for ease of understanding.

The ionization chamber 10 is provided with a chamber (housing) 11 in a rectangular parallelepiped form (width of 60 cm×depth of 60 cm×height of 80 cm, for example), a sample stage 50, an optical microscope 30 and a laser light source 41. Thus, a space is created inside the chamber 11.

In addition, an exhaust duct (exhaust pipe) 13 in a circular pipe form (outer diameter of 6 cm and inner diameter of 5 cm) is formed in the upper right portion of the chamber 11 according to the first embodiment. The exhaust duct 13 is arranged so that the downward-facing (−Z direction) inlet 13*a* is located above the sample S, which is placed at a predetermined ionization point $P_2$, and the outlet is located outside the chamber 11. Furthermore, an axial-flow fan 15 for drawing air into the exhaust duct 13 in the Z direction (upwards) is provided in the exhaust duct 13. The axial-flow fan 15 makes it possible to adjust the airflow volume.

A heater block including a built-in temperature adjusting mechanism is fixed to the right sidewall of the chamber 11, and an introduction pipe 12 in a circular pipe form is created in the heater block. The introduction pipe 12 is in an L shape and is arranged in such a manner that the inlet faces downwards (−Z direction), the portion close to the inlet is located at the center of the exhaust duct 13, the portion close to the outlet penetrates through a sidewall of the exhaust duct 13, and the outlet faces to the right (X direction) inside the first middle vacuum chamber 21.

In addition, a circular airflow-in route 19 (diameter of 5 cm, for example) is created in the lower portion of the left sidewall of the chamber 11 according to the first embodiment. Furthermore, a filter 19*a* is provided in the airflow-in route 19 in order to prevent dust from entering into the chamber 11.

In this ionization chamber 10, a predetermined volume of air is drawn into the exhaust duct 13 so as to be discharged to the outside of the chamber 11 and at the same time a predetermined volume of air is introduced into the chamber 11 through the airflow-in route 19 when the axial-flow fan 15 is in operation so as to generate an appropriate volume of airflow. The analysis point on the sample S, which is placed at a predetermined ionization point $P_2$ by means of the sample stage 50, is irradiated from above by a laser beam L emitted from the laser light source 41. When the analysis point on the sample S is irradiated by the laser beam L, the target substance at the analysis point on the sample S is rapidly heated, vaporized and ionized. Fine particles are also generated at the time of this ionization.

Furthermore, the air present inside of the chamber 11 flows into the first middle vacuum chamber 21 through the introduction pipe 12 due to the difference in pressure between the inside of the chamber 11 and the inside of the first middle vacuum chamber 21. The ions generated inside of the chamber 11 are also drawn into the introduction pipe 12 by riding on this airflow and are discharged into the first middle vacuum chamber 21. Meanwhile, ions and fine particles that have not been introduced into the introduction pipe 12 are discharged to the outside of the chamber 11 through the exhaust duct 13 together with a certain volume of air that was present inside the chamber 11.

Figure 3:
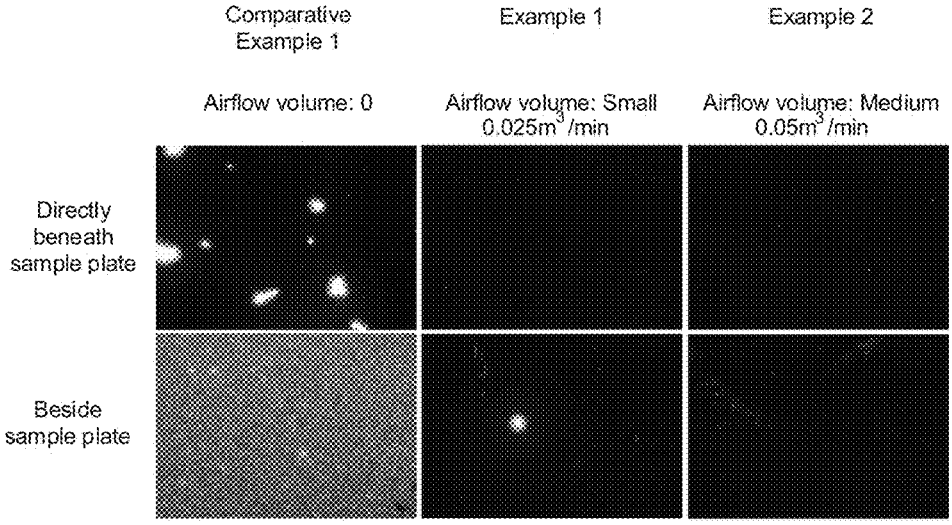
FIG. 3 shows photographs presenting the relationship between the airflow volume of an axial-flow fan and the amount of ions and fine particles spreading inside of the chamber.

Here, the relationship between the airflow volume provided by the axial-flow fan 15 and the amount of ions and fine particles spreading inside the chamber 11 is described. FIG. 3 shows photographs presenting the relationship between the airflow volume of the axial-flow fan 15 and the amount of ions and fine particles spreading inside of the chamber 11.

FIG. 3 shows photographs at the time of analysis after the fluorescent substance (sample) S has been irradiated by a laser beam L having a laser irradiation diameter of 100 μm from the laser light source 41 for 34 hours. The photographs in the top row show the bottom surface of the chamber beneath the sample table (−Z direction), and the photographs in the bottom row show a peripheral portion of the sample plate on the sample table.

Comparative Example 1 shows photographs when the axial-flow fan 15 was not in operation (airflow volume of 0). Example 1 shows photographs when the axial flow fan 15 is in operation so as to provide an airflow volume of 0.025 $m^3$/min. Example 2 shows photographs when the axial flow fan 15 is in operation so as to provide an airflow volume of 0.05 $m^3$/min.

It can be seen in Comparative Example 1 that large amounts of ions and fine particles adhere to the bottom surface of the chamber 11 (directly beneath the sample plate) beneath the sample table as well as to the peripheral portion (sides) of the sample plate on the sample table. Meanwhile, it can be seen in Example 1 and Example 2 that almost no ions or fine particles adhere to the bottom surface of the chamber 11 beneath the sample table or to the peripheral portion of the sample plate on the sample table.

Figure 4:
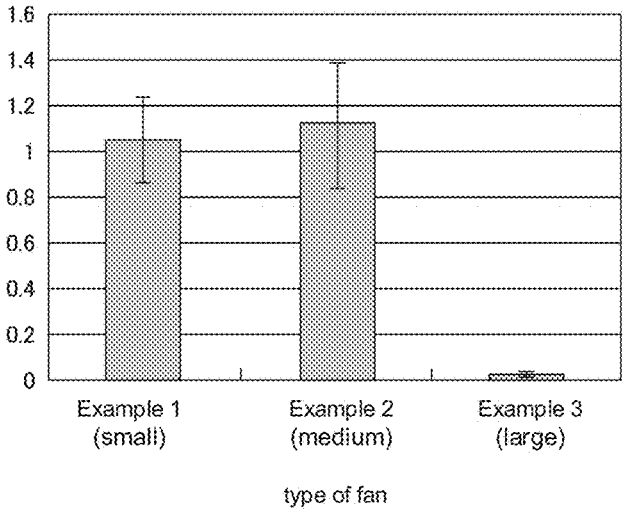
FIG. 4 is a graph showing the relationship between the airflow volume of an axial-flow fan and the amount of collected ions detected by the ion detector.

Next, the relationship between the airflow volume provided by the axial-flow fan 15 and the amount of collected ions that have been detected by the ion detector 24 is described. FIG. 4 is a graph illustrating the relationship between the airflow volume provided by the axial-flow fan 15 and the amount of collected ions that have been detected by the ion detector 25.

The graph of FIG. 4 shows the ratios of the amounts of collected ions to the standard amount when AngiotensinII+DHB is analyzed as the sample S, where the standard amount is the amount of ions collected when the axial-flow fan 15 is not in operation, and thus the ratio is 1.0 when the axial-flow fan 15 is not in operation.

Example 1 shows the ratio of collected ions when the axial flow fan 15 is in operation so as to provide an airflow volume of 0.025 $m^3$/min. Example 2 shows the ratio of collected ions when the axial flow fan 15 is in operation so as to provide an airflow volume of 0.05 $m^3$/min. Example 3 shows the ratio of collected ions when the axial flow fan 15 is in operation so as to provide an airflow volume of 0.4 $m^3$/min.

There is almost no change in the amount of collected ions in both Example 1 and Example 2, whereas the amount of collected ions is reduced in Example 3. Therefore, it can be seen that the amount of collected ions is affected when the airflow volume for suctioning air through the exhaust duct 13 is too high.

As described above, in the atmospheric pressure MALDI mass spectrometer 1 according to the present invention, ions and fine particles that have not been drawn into the introduction pipe 12 are suctioned up by the exhaust duct 13, and therefore can be prevented from spreading inside the chamber 11 so that the contamination region can be limited. At this time, optimization of airflow volume provided by the axial flow fan 15 can help to prevent ions from being affected by the gas flow and thus allow them to be more easily drawn into the introduction pipe. As a result, ions can be prevented from affecting the MS sensitivity.

Second Embodiment

Figure 5:
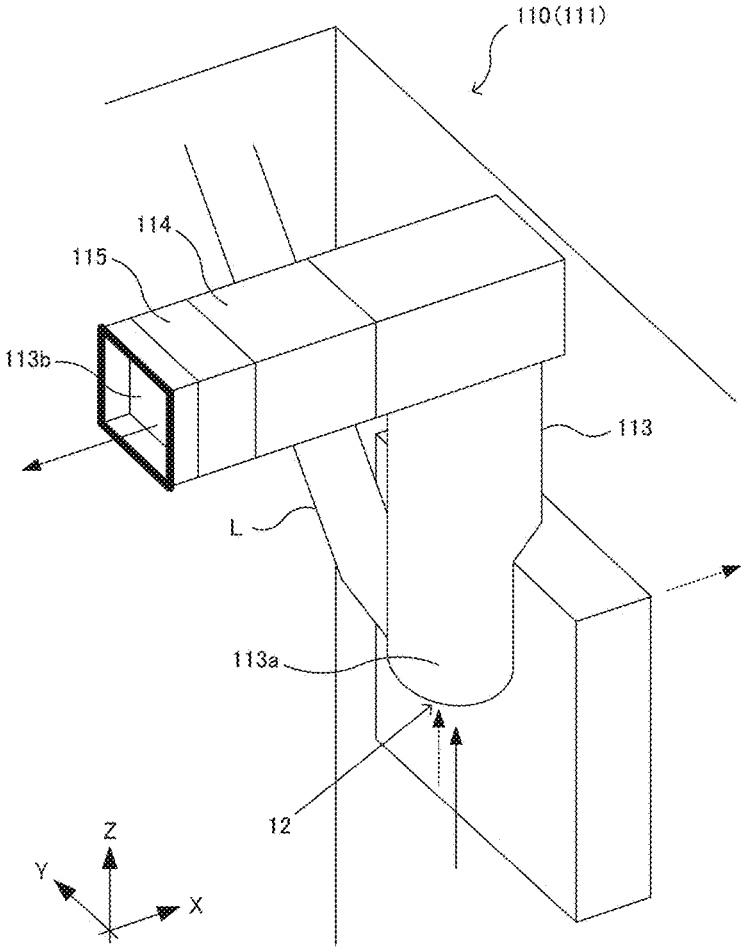
FIG. 5 is a perspective diagram showing the configuration of the main portion of the ionization chamber in the second embodiment.
Figure 6:
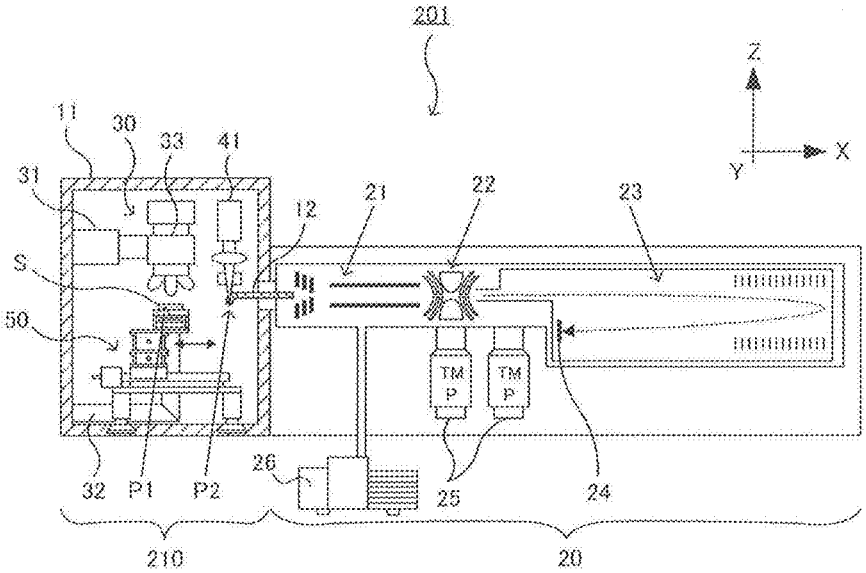
FIG. 6 is a diagram showing the entire configuration of a conventional atmospheric pressure MALDI mass spectrometer.

Though the above-described atmospheric pressure MALDI mass spectrometer 1 has such a structure that the outlet of the exhaust duct 13 is located outside the chamber 11, it may have such a structure that a collection unit 114 is formed in the exhaust duct 113 and the outlet 113*b* of the exhaust duct 113 is located inside the chamber 111. FIG. 5 is a perspective diagram showing the structure of the main portion of the ionization chamber 110 according to the second embodiment. Here, the same symbols are attached to the same components as in the above-described atmospheric pressure MALDI mass spectrometer 1, and therefore the description thereof are not repeated.

The ionization chamber 110 is provided with a chamber (housing) 111 in a rectangular parallelepiped form (width of 60 cm×depth of 60 cm×height of 80 cm, for example), a sample stage 50, an optical microscope 30 and a laser light source 41. Thus, a space is created inside the chamber 111.

In addition, an exhaust duct (exhaust pipe) 113 in a circular pipe form (outer diameter of 6 cm and inner diameter of 5 cm) is formed in the upper right portion of the chamber 111 according to the second embodiment. The exhaust duct 113 is arranged so that the downward-facing (−Z direction) inlet 113*a* is located above the sample S, which is placed at a predetermined ionization point $P_2$, and the outlet 113*b* is located at the top inside of the chamber 111 and faces to the left (−X direction). Furthermore, a collection unit 114 and an axial-flow fan 115 for drawing air into the exhaust duct 13 in the Z direction (upwards) and discharging the air to the left (−X direction) at the top inside of the chamber 111 are provided in the exhaust duct 13.

The collection unit 114 has a housing in a quadrilateral pipe form and a filter inside the housing so that air that includes ions and fine particles that have not been introduced into the introduction pipe 12 can flow through the housing after entering from one end, allowing the ions and fine particles to be collected by the filter inside the housing, and after that the air from which the ions and fine particles have been removed can be discharged through the other end of the housing.

It is preferable for the above-described filter to have an antimicrobial action, and examples are separator/HEPA (high efficiency particulate air) filters (trade names: sterilization/enzyme PACMAN made by Cambridge Filter Japan, Ltd.).

Such an ionization chamber 110 allows a predetermined volume of air to be drawn into an exhaust duct 113 when an axial-flow fan 115 is in operation so as to provide an appropriate airflow volume and allows the predetermined volume of air to be discharged into the chamber 11 after passing through the collection unit 114. The analysis point on the sample S, which is placed at a predetermined ionization point $P_2$ by means of the sample stage 50, is irradiated from above by a laser beam L emitted from the laser light source 41. When the analysis point on the sample S is irradiated by the laser beam L, the target substance at the analysis point on the sample S is rapidly heated, vaporized and ionized. Fine particles are also generated at the time of this ionization.

Furthermore, the air present inside of the chamber 111 flows into the first middle vacuum chamber 21 (see FIG. 1) through the introduction pipe 12 due to the difference in pressure between the inside of the chamber 111 and the inside of the first middle vacuum chamber 21. The ions generated inside of the chamber 111 are also drawn into the introduction pipe 12 by riding on this airflow and are discharged into the first middle vacuum chamber 21. Meanwhile, ions and fine particles that have not been introduced into the introduction pipe 12 are introduced into the collection unit 114 through the exhaust duct 113 together with a certain volume of air that was present inside the chamber 111. The correction unit 114 allows air that contains ions and fine particles that have not been introduced into the introduction pipe 12 to flow through the housing so that the ions and fine particles are collected by the filter, and then allows the air from which the ions and fine particles have been removed to be discharged into the chamber 111.

As described above, in the atmospheric pressure MALDI mass spectrometer according to the second embodiment of the present invention, the ions and fine particles that have not been drawn into the introduction pipe 12 are suctioned into the exhaust duct 113 so as to be collected by the collection unit 114. Therefore, the ions and fine particles can be prevented from spreading inside the chamber 111 and at the same time the contamination region can be limited only to the collection unit 114.

Other Embodiments (1) Though the above-described atmospheric pressure MALDI mass spectrometer 1 has such a configuration where a matrix-assisted laser desorption/ionization method is used, other ionization methods such as the following may be used in the configuration: another type of laser desorption/ionization method, a desorption electro spray ionization method for spraying a charged droplet onto a sample, or a Penning ionization method using metastable atoms such as of He may be used in the configuration.

(2) Though the above-described atmospheric pressure MALDI mass spectrometer 1 has such a configuration where an optical microscope 30 is provided in order to determine the analysis point (specified point) on the sample S, the observation means may be provided with a zoom lens or the like in the configuration.

(3) Though the above-described atmospheric pressure MALDI mass spectrometer 1 has such a configuration where the L-shaped introduction pipe 12 in a circular pipe form is formed in the right sidewall of the chamber 11, the device may be configured to allow the right sidewall of the chamber to employ a linear introduction pipe in a circular pipe form, or a circular or quadrilateral introduction hole.

INDUSTRIAL APPLICABILITY

The present invention is appropriate for application to an atmospheric pressure MALDI mass spectrometer for ionizing a sample in accordance with a matrix-assisted laser desorption/ionization method or another type of laser desorption/ionization method under atmospheric pressure, or in an atmosphere where the gas pressure is close to atmospheric pressure, so that the generated ions are transported into a high vacuum atmosphere for mass spectroscopy.

EXPLANATION OF SYMBOLS

1 Atmospheric pressure MALDI mass spectrometer
10 Ionization chamber
11 Chamber (housing)
12 Introduction pipe
13 Exhaust duct
15 Axial-flow fan
21 First middle vacuum chamber
22 Second middle vacuum chamber
23 Analysis chamber
24 Ion detector

The invention claimed is:

1. A mass spectrometer, comprising:
an ionization chamber for ionizing a sample on its surface at an analysis point through irradiation by a laser beam;
an analysis chamber having a mass spectroscope for detecting ions,
an introduction pipe or an introduction hole provided at one location of said ionization chamber for introducing ions into the inside of said analysis chamber from the inside of a housing of said ionization chamber;
an exhaust pipe formed inside the housing of said ionization chamber at another location of said ionization chamber; and
a fan provided within the exhaust pipe for drawing air into said exhaust pipe, and
wherein air that contains ions and/or fine particles generated from said sample, which have not been introduced into said introduction pipe or introduction hole, can be suctioned from said ionization chamber into said exhaust pipe when said fan is in operation,
the ionization method implemented in said ionization chamber is a matrix-assisted laser desorption/ionization method or a laser desorption/ionization method.

2. The mass spectrometer according to claim 1, characterized in that
said exhaust pipe communicates with the outside of the housing of said ionization chamber,
an airflow-in route is formed on a wall of said ionization chamber, and
air that contains ions and/or fine particles, which have not been introduced into said introduction pipe or introduction hole, can be discharged to the outside of the housing of said ionization chamber.

3. The mass spectrometer according to claim 2, characterized in that a filter for removing dust is provided within said airflow-in route.

4. The mass spectrometer according to claim 1, characterized in that
said exhaust pipe is connected with a collection unit, and
air that contains ions and/or fine particles, which have not been introduced into said introduction pipe or introduction hole, can be collected in said collection unit.

5. The mass spectrometer according to claim 4, characterized in that air that contains ions and/or fine particles, which have not been introduced into said introduction pipe or introduction hole, can be returned to the inside of the housing of said ionization chamber after ions and/or fine particles have been collected in said collection unit.

6. The mass spectrometer according to claim 4, characterized in that a filter having an antimicrobial action is provided in said collection unit.

7. The mass spectrometer according to claim 1, characterized in that the size of the inlet of said exhaust pipe is greater than the size of the inlet of said introduction pipe or introduction hole, and said introduction pipe or introduction hole is provided inside the inlet of said exhaust pipe.

* * * * *